United States Patent [19]

Sakamoto et al.

[11] 4,051,706

[45] Oct. 4, 1977

[54] METHOD OF MAKING ANISOTROPIC PERMANENT MAGNETS OF MN-AL-C ALLOYS

[75] Inventors: Yoichi Sakamoto, Hirakata; Nobuyuki Kato; Tadao Ohtani, both of Katano, all of Japan

[73] Assignee: Matsushita Electric Industrial Co., Ltd., Japan

[21] Appl. No.: 592,314

[22] Filed: July 1, 1975

[30] Foreign Application Priority Data

July 11, 1974 Japan ..... 49-79789

[51] Int. Cl.[2] ..... B21C 23/00; H01F 1/00; H01F 7/02

[52] U.S. Cl. ..... 72/253 R; 29/608; 148/120; 72/467; 72/700; 72/DIG. 31

[58] Field of Search ..... 29/608; 72/467, 253, 72/700, DIG. 31; 148/120; 75/134 M

[56] References Cited

U.S. PATENT DOCUMENTS

| | | | |
|---|---|---|---|
| 2,971,644 | 2/1961 | Sejournet | 72/253 |
| 3,118,795 | 1/1964 | Kolbe | 148/120 X |
| 3,661,567 | 5/1972 | Yamamoto | 75/134 M |
| 3,730,784 | 5/1973 | Yamamoto | 75/134 M |
| 3,771,221 | 11/1973 | Bachmann et al. | 29/608 |
| 3,886,775 | 6/1975 | Korsell et al. | 72/467 X |
| 3,944,445 | 3/1976 | Ohtani et al. | 148/120 X |
| 3,976,519 | 8/1976 | Kubo | 148/120 |

*Primary Examiner*—C.W. Lanham
*Assistant Examiner*—D. M. Gurley
*Attorney, Agent, or Firm*—Wenderoth, Lind & Ponack

[57] ABSTRACT

Anisotropic permanent magnets of Mn-Al-C polycrystalline alloy are produced by warm extrusion at a temperature of 530° to 830° C utilizing converging or tapered dies with lubricant interposed between the polycrystalline body and the converging die. With dies of rather small semiangles, alloys with improved magnetic properties with regard to (BH)max, and especially Br are obtained.

6 Claims, 4 Drawing Figures

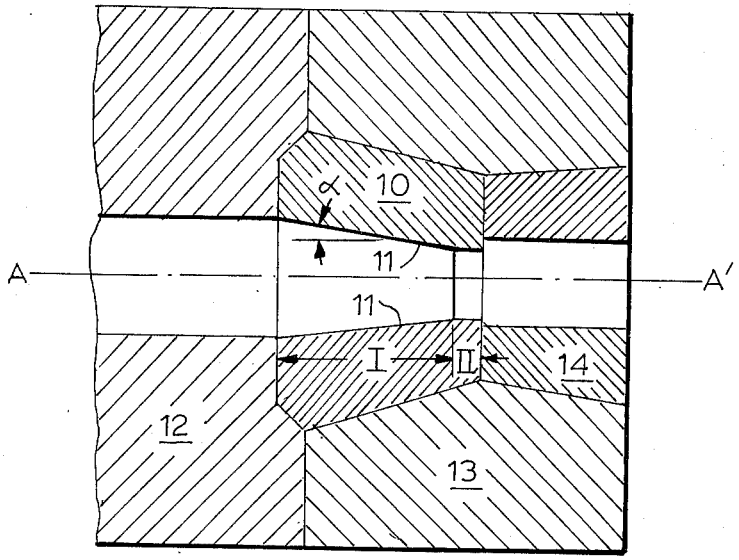
FIG. 1
FIG. 2a
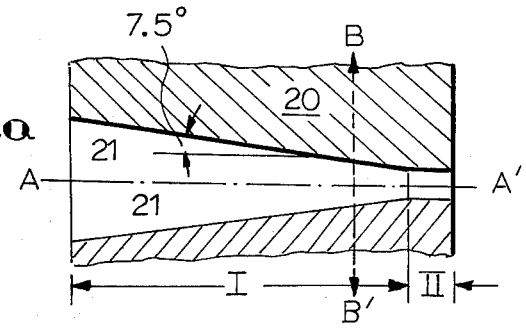
FIG. 2b
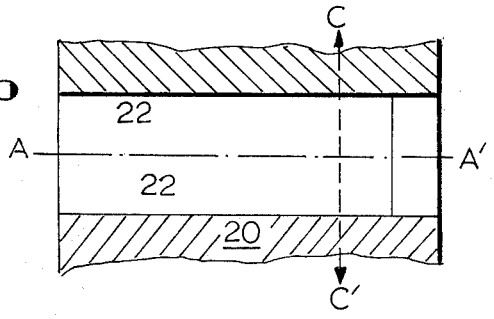
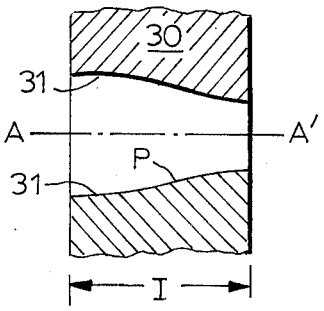
FIG. 3

METHOD OF MAKING ANISOTROPIC PERMANENT MAGNETS OF Mn-Al-C ALLOYS

BACKGROUND OF THE INVENTION

This invention relates to permanent magnets and more particularly to methods for making anisotropic permanent magnets of manganese-aluminum-carbon (Mn-Al-C) alloys.

Previously known Mn-Al alloy magnets consisting of Mn 60 ~75 weight % (hereinafter referred to simply as %) and the remainder Al are such that the ferromagnetic metastable $\tau$-phase is obtained by a heat treatment, e.g. the cooling control method or the quenching-tempering method. The Mn-Al alloy magnets, however, possess magnetic properties which are low, i.e. in the order of (BH)max$=0.5\times10^6$ G.Oe.

Since then, a method has been proposed for improving the magnetic properties of Mn-Al alloy magnets by applying a high degree of cold-working, i.e. swaging to the alloy to render it anisotropic. It is known that rod shaped Mn-Al alloy magnets in the ferromagnetic phase are sealed in non-magnetic stainless steel pipes, and while being held in said pipes, are subjected to swaging to a degree of 85~95%. This method is capable of producing an anisotropic permanent magnet possessing magnetic properties in the order of (BH) max$\approx3.5\times10^6$ G.Oe in the direction of preferred magnetization, i.e., the axial direction of the rod. Because Mn-Al alloy magnets are intermetallic compounds having very hard and brittle mechanical properties, however, even a cold-working of less than 1% causes cracks or fractures in the alloys.

On the other hand, since the degree of anisotropization is dependent upon the degree of cold working, it is necessary to cold-work the alloy to a high degree, normally higher than 80%, in order to achieve satisfactory magnetic properties and in order to be able to conduct such cold-working step, the cold-working operation must be conducted while the alloy is sealed in a non-magnetic stainless steel pipe.

An anisotropic permanent magnet obtained by using the above method is complicated in that the Mn-Al alloy inside the pipe must be finely pulverized into powder, and, moreover, it is difficult to obtain rods of uniform cross-section. The method is therefore costly and of little practical value.

In order to overcome the above difficulties, a method has been proposed for obtaining a rod shaped anisotropic Mn-Al alloy magnet by subjecting the Mn-Al alloy magnet to hydrostatic extrusion at a temperature below 200° C, but the magnetic properties of such alloys is low, being in the order of (BH) max$=2.5\sim3.6\times10^6$ G.Oe in the direction of preferred magnetization. This method also required a very intricate hydrostatic extrusion operation and is again a very impractical method.

On the other hand, Mn-Al-C alloy magnets are isotropic permanent magnets in bulk shape excelling in magnetic properties, stability, weathering resistance and mechanical strength, and are disclosed in U.S. Pat. No. 3,661,567. Thus, according to U.S. Pat. No. 3,661,567, these alloys may be multicomponent alloys containing impurities or additives other than Mn, Al, and C, but should contain Mn, Al, and C as indispensable components. Isotropic permanent magnets with excellent magnetic properties, i.e. better than (BH)max$=1.0\times10^6$ G.Oe, while in an isotropic state (which is twice as high as the magnetic properties of isotropic Mn-Al alloy magnets) are manufactured by the quenching-tempering method with the component ratio of Mn, Al, and C in these multi-component alloys falling within the following range:

Mn 69.5~73.0 %
Al 26.4~29.5 %
C 0.6~($\frac{1}{3}$ Mn − 22.2) %

Subsequently, methods of warm plastic deformation of Mn-Al-C alloys have been devised to improve their magnetic properties. According to co-pending U.S. Patent Application, Ser. No. 491,498, now U.S. Pat. No. 3,976,519, issue date Aug. 24, 1976, said warm plastic deformation in the temperature range of 530° C~830° C provides Mn-Al-C alloy magnets of both single crystals and polycrystals with striking improvement in magnetic properties. In the compositional range wherein Mn is 68.0~73.0%, C is (1/10 Mn−6.6)~($\frac{1}{3}$Mn−22.2)% and wherein the remainder Al, there is produced a permanent magnet with magnetic properties such that the (BH)max is above $4.8\times10^6$ G.Oe up to about $9.2\times10^6$ G.Oe is its bulk state.

While the above process provides single crystal magnets having a (BH)max of up to about $9.2\times10^6$ G.Oe, polycrystalline Mn-Al-c alloy magnets with the (BH)max above $4.8\times10^6$ G.Oe and up to about $7.8\times10^6$ G.Oe may also be obtained by the warm plastic deformation, e.g. warm extrusion. Compared with the rather complicated procedure for making single-crystal Mn-Al-C alloy magnets, the method of making polycrystalline Mn-Al-C alloy magnets by warm plastic deformation is much simpler and accordingly, is of high industrial value.

Furthermore, aforementioned co-pending application, Ser. No. 491,498 indicates that a remarkable improvement in magnetic properties is realized from the above-described plastic deformation and highly increased degree of anisotropization and that this is a new phenomenon based on a mechanism peculiar to the Mn-Al-C alloy magnets. This application further indicates that C is an indispensable component element. For example, in the case of Mn-Al alloy magnets, it was confirmed that slight plasticity appeared above 580° C, but that by the working above 530° C, no improvement in magnetic properties was recognized at all, rather, the magnetic properties were greatly degraded.

As disclosed in said co-pending application, Ser. No. 491,498, the Mn-Al-C alloys are magnetically directionalized by use of warm plastic deformation in a restricted condition, in which the warm plastic deforming should be applied in a specific direction in the temperature range of 530°~830° C in order to cause the sliding of the plane of atoms in a specific direction. The magnetic directionalization can be made by said sliding of plane of atoms from any phases containing carbon as an indispensable component element, i.e., the close-packed hexagonal $\epsilon$-phase, orthorhombic $\epsilon'$-phase, face-centered tetragonal $\tau$-phase, or a plurality of said phases. The $\epsilon'$ is a newly found intermediate phase in the $\epsilon\rightleftarrows\tau$ transformation, which is represented by B 19-type structure (lattice constants, $a=4.371$ A, $b=2.758$ A and $c=4.582$ A).

The experimental studies on the Mn-Al-C single crystals have made it clear that only the restricted directional deformation or to be more precise, the direction of the compression to be restricted within the specific directional range, crystallographically causes the atom sliding so that the formation of the objective directional ferromagnetic $\tau$ phase is available. Said directional deformation should be one that causes the sliding of the plane of atoms in the $(0001)_\epsilon$ phase to the $[\bar{1}100]_\epsilon$ direction of the $\epsilon$ phase, in the same corresponding $(100)_{\epsilon'}$ plane to the $[001]_{\epsilon'}$ direction of the $\epsilon'$ phase, and the same corresponding $(111)_\tau$ plane to the $[\bar{1}\bar{1}2]\tau$ direction of the $\tau$-phase. With respect to the compression direction relative to the $\tau$-phase crystal orientation after deformation, compression in the direction nearly perpendicular to the $[001]\tau$ axis of the obtained $\tau$-phase single crystal after deformation, which axis is the objective direction of easy magnetization, facilitates sliding of the plane of atoms in every phase. When compressed under such conditions, deformation anisotropy was notable, i.e., remarkable shrinkage in the direction of the compression was observed, and notable elongation was recognized in the only one direction perpendicular to the compression direction. The direction where notable elongation was recognized is nearly the same as the direction of easy magnetization of the obtained $\tau$-phase single crystal. Accordingly, a magnetically anisotropic single crystalline magnet is the uni-directional $\tau$-phase was obtained from any of the phases mentioned above.

Thus, with regard to the single crystalline Mn-Al-C alloys, the necessity of the specific directional deformation was recognized for making magnetically anisotropic permanent magnets.

Regarding the polycrystalline Mn-Al-C alloys, said co-pending application, Ser. No. 491,498 also has indicated that as the alloys were upset in said temperature range, anisotropic permanent magnets with the direction of preferred magnetization being in the direction of diameter which was perpendicular to the direction of compression, were obtained. And, when the alloys were extruded, it was made clear that the direction of preferred magnetization was in the direction of extrusion.

However, behavior of the Mn-Al-C polycrystalline alloys under deformation in the warm extrusion process in very complicated because of effects such as diversification in orientation of minute crystals, grain boundaries and friction, etc. Because of the above difficulties, the influence of profiles of the extrusion dies bounding the alloys in order to cause plastic deformation therethrough is unclear. In particular, the contribution of the die angle to the formation of magnetically directionalized $\tau$-phase polycrystalline alloys, has not been clarified.

SUMMARY OF THE INVENTION

Accordingly it is a principal object of the present invention to provide a method of making an anisotropic permanent magnet of Mn-Al-C polycrystalline alloy having excellent magnetic properties in the extrusion direction.

It is a further object to provide a method of making an anisotropic permanent magnet of Mn-Al-C polycrystalline alloy having a magnetic property such as the (BH) max exceeds $6.0 \times 10^6$ G.Oe in its direction of preferred magnetization, i.e., the extrusion direction.

It is another object to provide a method of making a strong anisotropic permanent magnet of Mn-Al-C polycrystalline alloy, and eliminating formation of both internal and external ruptures such as central burst formation and dead zone formation during extrusion of the alloy.

It is further object to provide a method of making an anisotropic permanent magnet of Mn-Al-C polycrystalline alloy whose cross-section, which is perpendicular to the extrusion direction, is not only circular but can also be rectangular, etc.

These objects are achieved by subjecting a polycrystalline body of an alloy comprising Mn-Al-C system to warm extrusion by pushing said polycrystalline body through a converging or a tapered die at a temperature range of 530° to 830° C with lubricant interposed between said polycrystalline body and the converging die.

Hereinabove, an alloy comprising the Mn-Al-C system to be subjected to the warm extrusion means an alloy containing, as a main part, the Mn-Al-C alloy comprising of one or plurality of the phases of $\epsilon$, $\epsilon'$, and $\tau$. A magnetically well directionalized permanent magnet is produced from any of these phases by the method of this invention. The phases of $\epsilon$, $\epsilon'$, and $\tau$ should contain C as an indispensable component element, and the presence of a compound of carbon other than $Al_4C_3$, such as $Mn_3AlC$, is allowable. Also the alloy mentioned above includes an alloy containing impurities or additives other than Mn, Al and C.

Because $\epsilon'$-phase and $\tau$-phase are induced from $\epsilon$-phase, the most extensive compositional range, wherein the effect of this invention exists, is the compositional range wherein $\epsilon$-phase exists. However, a preferred compositional range of the three indispensable components, i.e., Mn, Al and C, is as follows:

Mn 68.0~73.0%
C (1/10 Mn−6.6~(⅓ Mn−22.2)%
Al remainder

Hereabove, the mathematical formula of (1/10 − 6.6) % represents the solubility limit of carbon in the ferromagnetic phase within the compositional range of 68.0~73.0 % Mn. And the mathematical formula of (⅓ Mn − 22.2) % is the boundary line of carbon concentration, in excess of which a compound of $Al_4C_3$ is formed at temperatures above the melting points of Mn-Al-C alloys. $Al_4C_3$, hydrolyzed by moisture in the air, etc., causes the alloys to crack, leading finally to the decay of alloys with the further proceeding of hydrolysis.

Other features and advantages of the invention will be apparent from the following description taken in connection with the accompanying drawings.

BRIEF DESCRIPTION OF THE DRAWINGS

FIG. 1 presents a schematic vertical section of a representative converging die with another die assembly.

FIG. 2 displays surroundings the converging die used in Example -2 as vertical sections. Each vertical section of FIG. 2(*a*) and FIG. 2(*b*) is perpendicular to the other.

FIG. 3 depicts surroundings of the converging die having a curved internal die profile used in Example 3, as a vertical section.

DESCRIPTION OF THE PREFERRED EMBODIMENTS

The present inventors have investigated into the influence of the die profile on the magnetic properties of the Mn-Al-C alloy magnet after warm extrusion.

As a result, it has been determined that a variation of the die profile greatly affects the magnetic characteristics of the product. Thus, the die angle was found to have a great influence on the formation of the magnetically directionalized $\tau$-phase polycrystals. This had not been clear from the disclosure of the co-pending application, Ser. No. 491,498, and said influce of the die angle was recognized only by the experimental results of the present invention for the first time.

These experimental results indicated that the Mn-Al-C system alloy exhibited peculiar behavior in the extrusion process, which behavior differs from ordinary metal extrusion. These results promote understanding of deformation anisotropy of single crystals and polycrystalline bodies.

A profile of one of the converging or tapered dies is shown in FIG. 1 as a schematic vertical section of the die assembly. A converging die 10 has an inclined internal die surface 11 converging with semiangle $\alpha$ to the extrusion direction A–A' in a converging portion I, and also has a bearing portion II. The die 10 is set with a container 12, a die holder 13 and a die backer 14. Thus a converging die has a converging portion in that the cross-sectional area of the internal opening of the die decreases along the extrusion direction. The reduction of area is defined by the following expression;

$$\text{reduction of area (\%)} = \left(1 - \frac{\text{cross-sectional area of the extruded material}}{\text{cross-sectional area of the billet}}\right) \times 100$$

The results achieved in this invention, which results will be disclosed in the following specific embodiments, indicate that an improved method of making an anisotropic Mn-Al-C alloy magnet by means of warm extrusion through a converging die has been developed. This invention does not place a restriction on the die assembly to be employed other than on the converging portion.

A converging surface of a die means a surface of rigid or immovable material which substantially contributes to deformation through the medium of a lubricating film. Accordingly, a die for this invention, for example, may be constructed so that the converging die is the immovable main part, and so that a lubricating film can be applied of itself thereto by way of the surface of said main part softening during warm extrusion.

When the semiangle $\alpha$ is small enough, the billet of polycrystalline Mn-Al-C system alloy undergoes rather uniform compressive deformation in the direction nearly perpendicular to the extrusion direction in the converging portion. Accordingly, said compression deformation results in the effective directional working, described before, which in turn results in an anisotropic Mn-Al-C system alloy magnet whose direction of preferred magnetization is in the extrusion direction. Judging from this point of view, it can be supposed that the smaller the semiangle $\alpha$ is, the more the die contributes to the magnetic properties of the product in the extrusion direction. This is the very point of this invention, which is confirmed by the experiments disclosed below.

Meanwhile, there exist some restrictions in the actual extrusion process. For example, it is restricted in the length of the converging portion, due to the various reasons described hereinafter. Because of certain degree of friction between a billet and a die exists, even though the contact surface is well lubricated, if the converging portion is too long, an influence of the friction on the required extrusion force becomes so large that it gives rise to substantial difficulty in the extrusion operation. Moreover, because the ferromagnetic $\tau$-phase obtained after the extrusion is metastable, too long a stay in the extrusion process, tends to cause a transformation into the non-magnetic stable phases, i.e. AlMn(r) phase and $\beta$-Mn phase, which phases are supposed to be unfavorable.

In view of the above-described difficulties, a die with too small a semiangle $\alpha$, resulting in too long a converging portion, is to be avoided. In Example 1 of this invention, a converging die with a semiangle $\alpha$ being equal to or greater than 2.5° in the sphere of small die angle, can be employed in a practical extrusion, and makes a good contribution to the magnetic characteristics of the extruded product.

Hereinabove, if the internal die surface is not axi-symmetric, which means that different semiangles exist around the axis of extrusion direction, the semiangle $\alpha$ to be discussed is that of the maximum semiangle of the converging die, wherein the converging surface of the die with said semiangle $\alpha$ substantially affects the deformation, and that substantially provides the length of the converging portion. Other die surfaces of the same die with smaller semiangles than the semiangle $\alpha$ defined above the permissible. For example, the existance of lateral die surface other than the inclined die-surfaces, in the same converging portion, like that of Example 2, which are a pair of plane surfaces being parallel to the extrusion direction whose semiangle can be expressed as 0°, are permissible. Other substantial variations are also possible.

Meanwhile, there are many variations of the die profile such that the semiangle varies along the extrusion direction. Some of the variations are, e.g. convex, cosine and sigmoidal, being known generically as a curved internal die profile. If the semiangle changes discontinuously, doubly shaped or plurally shaped die profiles can be employed. It is clear that these variations of the die profile stated hereinabove could be applied to this invention. Although it is difficult to define the representative semiangle $\alpha$ of the curved die, at least the mean value of the semiangle between the inlet and the exit of the converging portion should fall in the small semiangle range to be mentioned in the following example, in order to obtain an anisotropic permanent magnet of Mn-Al-C polycrystalline alloy with highly improved magnetic properties. It is preferred that the maximum semiangle along the extrusion direction also falls in the small semiangle range, if the partial internal surface of the die with larger semiangle, i.e., the maximum or nearly the maximum semiangle, provides a comparatively large reduction of area in relation to the total reduction of area of the curved die.

In order to realize the extrusion where the semiangle $\alpha$ of the converging die is small, the friction between the billet and the die should be reduced by lubrication. As a result of experiments, many lubricants including solid lubricants, dispersions and glass state lubricants were found to be capable of being used for the extrusion of this invention. The general trend for the relation between the semiangle $\alpha$ and the magnetic characteristics was almost the same qualitatively for various lubricants.

Furthermore, a better result is expected when said polycrystalline alloy undergoes compressive deformation in many directions centripetally around the extrusion direction, in order to provide said preferable directional deformation on every minute crystal diversified in orientation. Accordingly, a converging die with an axi-symmetric internal die surface whose semiangle $\alpha$ is small, is considered to be the best die for making an anisotropic permanent magnet of Mn-Al-C system polycrystalline alloy. This will be clear from the following examples.

EXAMPLE 1

From a casting having a composition of 69.48% Mn, 29.98% Al and 0.54% C, as chemically analyzed, cylindrical billets of 20mm $\phi \times$ 35mm were cut. After holding them at a temperature of 1150° C for 2 hours, the billets were rapidly cooled at a rate of about 500° C/min., and were further subjected to tempering at 550° C for 30 minutes. As examined by X-ray difraction, $\tau$-phase was detected. Said billets of Mn-Al-C polycrystalline alloy were subjected to an axi-symmetric extrusion, whose reduction of area was 64 %, at a temperature of 700° C. The experiment was performed, respectively, by extruding through a conical die of different die angles. A dummy billet of various lengths for each case was employed in order to push the test billet through the converging die. The billet was lubricated with a graphite-copper-glass system composite lubricant.

The result of the experiment is shown in Table 1, wherein mean stationary extrusion pressure and magnetic properties are presented in relation to the semiangle $\alpha$ of the die.

Table 1

| Semiangle degree | means stationary extrusion pressure Kg/mm² | magnetic properties Br G. | bHc Oe. | (BH)max x $10^6$ G.Oe. |
|---|---|---|---|---|
| 2.5 | 67 | 6000 | 1750 | 5.1 |
| 5 | 54 | 6400 | 2200 | 6.2 |
| 7.5 | 46 | 6500 | 2600 | 7.1 |
| 10 | 42 | 6450 | 2700 | 7.2 |
| 15 | 40 | 6300 | 2700 | 6.9 |
| 20 | 39 | 5950 | 2550 | 6.1 |
| 25 | 42 | 5050 | 2350 | 4.5 |
| 30 | 44 | 4100 | 2300 | 3.6 |
| 45 | 61 | 3900 | 2250 | 3.0 |
| 60 | 89 | 3850 | 2150 | 2.8 |

As a result, anisotropic permanent magnets of Mn-Al-C polycrystalline alloy, whose direction of preferred magnetization was in the axis of each product, which was the extrusion irection, were obtained with each converging die of different die angles shown in Table 1. It is worthy of special mention that the magnetic properties, especially maximum energy product ((BH)max) and residual magnetic flux density (Br), which closely relates to the alignment of [001]$\tau$ axis of the ferromagnetic $\tau$-phase crystals, were improved as the semiangle $\alpha$ of the die decreased. This trend was accelerated with the semiangle $\alpha$ in the range from 30° to 20°. Meanwhile, a small amount of decline in magnetic properties appeared with the semi-angle $\alpha$ lowered beyond 7.5°, which was the semiangle $\alpha$ providing nearly the maximum value in both (BH)max and Br in this example. This can perhaps be explained by some unfavorable effects an application to the practice such as friction and increase of extrusion pressure. But this unfavorable influence is rather smaller than the desirable contribution of the small die angle. For example, comparing two representative cases, i.e. where the semiangle $\alpha$ is 2.5° and 45°, in spite of exhibiting nearly the same extrusion pressure, the die with the semiangle $\alpha$ of 2.5° provided much superior magnetic properties than the die with the semiangle $\alpha$ of 45° did, as shown in Table 1. Accordingly, regarding this example, anisotropic permanent magnets of Mn-Al-C polycrystalline alloy with preferred magnetic characteristics were provided when the semiangle $\alpha$ was smaller than or equal to 30°. Moreover, the optimum semiangle $\alpha$, which provided a (BH)max of greater than $6.0 \times 10^6$ G.Oe, was in the range of from 5° to 20°.

With respect to physical faults of the product, no dead zone formation occurred with every converging die shown in Table 1; whereas a flat die, whose semiangle can be expressed at 90°, caused dead zone formation. The die with semiangle $\alpha$ of 60° caused slight central bursting defects in the extruded product, while another converging die shown in Table 1 provided no internal opening defect. As the reduction of area being increased to 80%, however, no central bursting defect was found even for the semiangle $\alpha$ of 60°.

Furthermore, the result of the experiment with the dies of different reduction of area qualitatively showed the same tendency as that of Table 1 with respect to the relation between the magnetic properties and the semiangle $\alpha$ of the die. In other words, as the reduction of area varied from 50% to 95%, Br and (BH)max were increased in the range of small semiangle, and the optimum range of the semiangle $\alpha$ was from 5° to 20°.

Accordingly, it is clear that the magnetic characteristics depend greatly upon the die angle in a method of making an anisotropic permanent magnet of Mn-Al-C polycrystalline alloy by warm extrusion. Consequently, the die angle of the extrusion die for making an anisotropic permanent magnet of Mn-Al-C polycrystalline alloy is determined mainly by its contribution to the magnetic characteristics of the extruded product, in contrast with ordinary metal extrusion in which the die angle is determined mainly by technical problems such as minimization of extrusion pressure.

EXAMPLE 2

From a casting having a composition of 71.73% Mn, 27.39% Al and 0.88% C, as chemically analyzed, a 20 mm cubic test billet was cut out. Then after subjecting said test billet to heat treatment at a temperature of 1150° C for 2 hours, it was gradually cooled to 830° C at a cooling rate of 10°~15° C/min, and was then held at 830° C for 15 minutes. It was quenched from 830° C at a cooling rate of about 700° C/min. After the above heat-treatment, the test billet was found to consist of $\epsilon$-phase crystals and lamellae of a compound $Mn_3AlC$.

FIG. 2 shows a vertical cross-section of the area surrounding the internal opening of the converging die 20 used in the example. FIG. 2 *a* exhibits a pair of inclined internal die surfaces 21 respectively converging at 7.5° to the meridian plane which includes the extrusion direction (A–A') in a converging portion I. FIG. 2 *b* exhibits another veritical section of the same die along the meridian plane of FIG. 2 *a*. Thus the internal opening of the die in the converging portion I is made up of two different kinds of lateral plane surfaces, one of which is a pair of plane-symmetric inclined plane surfaces 21 converging with a semiangle of 7.5° to the extrusion direction (A–A'), and the other is a pair of plane surfaces 22 being parallel to the extrusion direction A–A'.

Said test billet was extruded with a dummy billet through the plane-symmetric converging die mentioned hereinabove, whose reduction of area was 75%. Extrusion temperature was at 750° C and punch speed was 5 mm.sec.$^{-1}$. The extruded product was sound and without any ruptures. Thereafter, it was tempered at 550° C for 30 min. Then, magnetic properties were measured in the extrusion direction. The result was as follows:

Br = 5800 G
BHc = 2350 Oe
(BH)max = $5.8 \times 10^6$ G.Oe

Accordingly, an anisotropic permanent magnet whose cross-section was a 20mm × 5mm rectangle was produced. Hereinabove, compressive deformation in the direction C–C′ was absent, providing every minute crystal with reduced probability of undergoing said preferred directional working. Unexpected yet fairly good magnetic characteristics were provided. These characteristics were a little worse than that realized by axi-symmetric extrusion. The probable explanation is that surplus compressive deformation in the direction B–B′ yielded compressive strains microscopically in the minute crystals in other directions including the direction C–C′ on the plane perpendicular to the extrusion direction A–A′.

Moreover, better magnetic properties than that of the above case were provided when the both pair of plane-symmetric internal die surfaces inclined with small semiangles.

EXAMPLE 3

From a casting having a composition of 70.36% Mn, 29.02% Al and 0.62% C, as chemically analyzed, a cylindrical billet of 20mmϕ × 30mm was cut out. After holding it at a temperature of 1050° C for 1 hour, the billet was rapidily cooled at a rate of about 400° C/min.

Said billet of Mn-Al-C polycrystalline alloy was subjected to an axi-symmetric extrusion, whose reduction of area was 64%, at a temperature of 650° C with a dummy billet to push the test billet through the converging portion. The punch speed was 12mm.sec$^{-1}$. Both the test billet and a dummy billet were coated with colloidal graphite lubricant, which was applied as a dispersion.

FIG. 3 is a vertical section of the converging die 30 used in this example, having a curved internal die profile. This profile of the die is also called sigmoidal, wherein the semiangle of the curved internal die surface 31 varies continuously along the extrusion direction A–A′ from 0° at the inlet of the converging portion I through the maximum angle at the point P to 0° again at the exit of the converging portion I. In this example, the maximum semiangle at the point P was 16° and the mean value of the semiangle between the inlet and the exit of the converging portion I was 7.5°.

The extruded product was sound, and the magnetic properties in the extrusion direction was as follows:

Br = 6500 G
BHc = 2550 Oe
(BH)max = $7.0 \times 10^6$ G.Oe

Then the measured specimen was subjected to tempering at a temperature of 600° C for 20 min. The magnetic properties in the extrusion direction after tempering were as follows:

Br = 6550 G
BHc = 2750 Oe
(BH)max = $7.7 \times 10^6$ G.Oe

We claim:

1. A method of making anisotropic permanent magnet which comprises the steps of (1) preparing a polycrystalline body of an alloy comprises of the Mn-Al-C system by melting and casting (2) subjecting said alloy to heat treatment, and (3) warm extruding at a temperature of 530° to 830° C in order to make said alloy anisotropic, said warm extruding step being performed by pushing said polycrystalline body through a converging die with lubricant interposed between said polycrystalline body and said converging die.

2. A method of making a permanent magnet according to claim 1, wherein the semiangle $\alpha$ of the converging die is in the range $2.5° \leqq \alpha \leqq 30°$.

3. A method of making a permanent magnet according to claim 1, wherein the semiangle $\alpha$ of the converging die is in the range $5° \leqq \alpha \leqq 20°$.

4. A method of making a permanent magnet according to claim 1, wherein the converging die comprises a axi-symmetric internal die surface which bounds said polycrystalline body in order to deform the same.

5. A method of making a permanent magnet according to claim 1, wherein the converging die comprises a pair of inclined internal die surfaces which is plane-symmetric about the meridian plane including the axis of the die.

6. A method of making a permanent magnet according to claim 1, wherein the converging die comprises a curved internal die profile.

* * * * *